US006347440B1

(12) United States Patent
Duval et al.

(10) Patent No.: US 6,347,440 B1
(45) Date of Patent: Feb. 19, 2002

(54) CIRCULAR NEEDLING MACHINE PROVIDED WITH A DEVICE FOR AUTOMATICALLY REMOVING PREFORMS

(75) Inventors: Renaud Duval, Les Cheres; Thierry Marjollet, Besancon; Robert Jean, Fouqueville, all of (FR)

(73) Assignee: Messier-Bugatti, Velizy-Villacoublay (FR)

( * ) Notice: Subject to any disclaimer, the term of this patent is extended or adjusted under 35 U.S.C. 154(b) by 0 days.

(21) Appl. No.: 09/900,372

(22) Filed: Jul. 6, 2001

(30) Foreign Application Priority Data

Apr. 30, 2001 (FR) ..... 01 05797

(51) Int. Cl.[7] ..... D04H 18/00
(52) U.S. Cl. ..... 28/107
(58) Field of Search ..... 28/103, 107, 111, 28/113, 114, 115

(56) References Cited

U.S. PATENT DOCUMENTS 5,664,305 A * 9/1997 Lawton et al. ..... 28/107
6,009,605 A * 7/2000 Olry et al. ..... 28/107
6,183,583 B1 * 2/2001 Duval et al. ..... 28/107
6,237,203 B1 * 5/2001 Sheehan et al. ..... 28/107
6,248,417 B1 * 6/2001 Ponsolle et al. ..... 28/107

* cited by examiner

*Primary Examiner*—Danny Worrell
(74) *Attorney, Agent, or Firm*—Weingarten, Schurgin, Gagnebin & Lebovici LLP

(57) ABSTRACT

A machine for needling a textile structure built up from a helical strip delivered by strip supply means, said machine comprising a needling table, a needling head, cutting means for cutting the helical strip, and conical roller drive means for rotating said strip on the needling table, at least a fraction of said conical roller drive means being retractable so as to release an empty space on said needling table enabling ejector means to remove the textile structure from the needling table.

8 Claims, 3 Drawing Sheets

CIRCULAR NEEDLING MACHINE PROVIDED WITH A DEVICE FOR AUTOMATICALLY REMOVING PREFORMS

FIELD OF THE INVENTION

The present invention relates to the field of needled textile structures and it relates more particularly to a device for automatically removing such structures after they have been needled in a circular type needling machine.

PRIOR ART

In circular type needling machines, the annular preform for needling is placed on a needling table which is rotated by drive means. This gives rise to a particular difficulty with removing the preform once needling has been completed, particularly when preform production is to be performed automatically without manual intervention. The present practice consists essentially in lowering the table at the end of manufacture so as to enable an operator to extract manually the preform made in this way from the machine.

OBJECT AND DEFINITION OF THE INVENTION

The present invention thus seeks to solve this specific problem with a needling machine that includes a device for automatically removing preforms. An object of the invention is also to provide such a device without significantly altering the initial structure of a circular type needling machine, and in particular while remaining within the same general size.

These objects are achieved by a needling machine for needling a textile structure built up from a helical strip delivered by strip supply means, the machine comprising a needling table that is vertically movable, a needling head including a determined number of barbed needles and placed over said needling table in a needling zone, and driven with vertical reciprocating motion, cutting means for cutting said strip once a predetermined thickness for said textile structure has been obtained, and conical roller drive means for rotating said strip on said needling table until a textile structure has been built up with said predetermined thickness, wherein at least a fraction of said conical roller drive means is movable so as to be retracted to release an empty space over said needling table enabling ejector means to remove said textile structure from said needling table.

Thus, with this particular structure, once needled preforms have been made, they can be removed easily and automatically.

In a particular embodiment, said ejector means may comprise thrust means placed level with said needling table, said thrust means possibly comprising either an actuator or a pivoting fork whose thrust tine acts directly on the periphery of said textile structure, or else a manipulator arm provided with gripping means for taking hold of said textile structure and removing it from said needling table.

Preferably, at least one of said conical roller drive means is mounted on a support tray capable of sliding on a rail extending transversely to the thrust direction of said thrust means and includes motor means enabling it to be moved along the rail. Advantageously, the motor means include an electrically controlled actuator. In an alternative embodiment, the rail extends following a circular arc from an initial drive position.

BRIEF DESCRIPTION OF THE DRAWINGS

The characteristics and advantages of the present invention appear better from the following description given by way of non-limiting indication and made with reference to the accompanying drawings, in which.

DETAILED DESCRIPTION OF A PREFERRED EMBODIMENT

Figure 1:
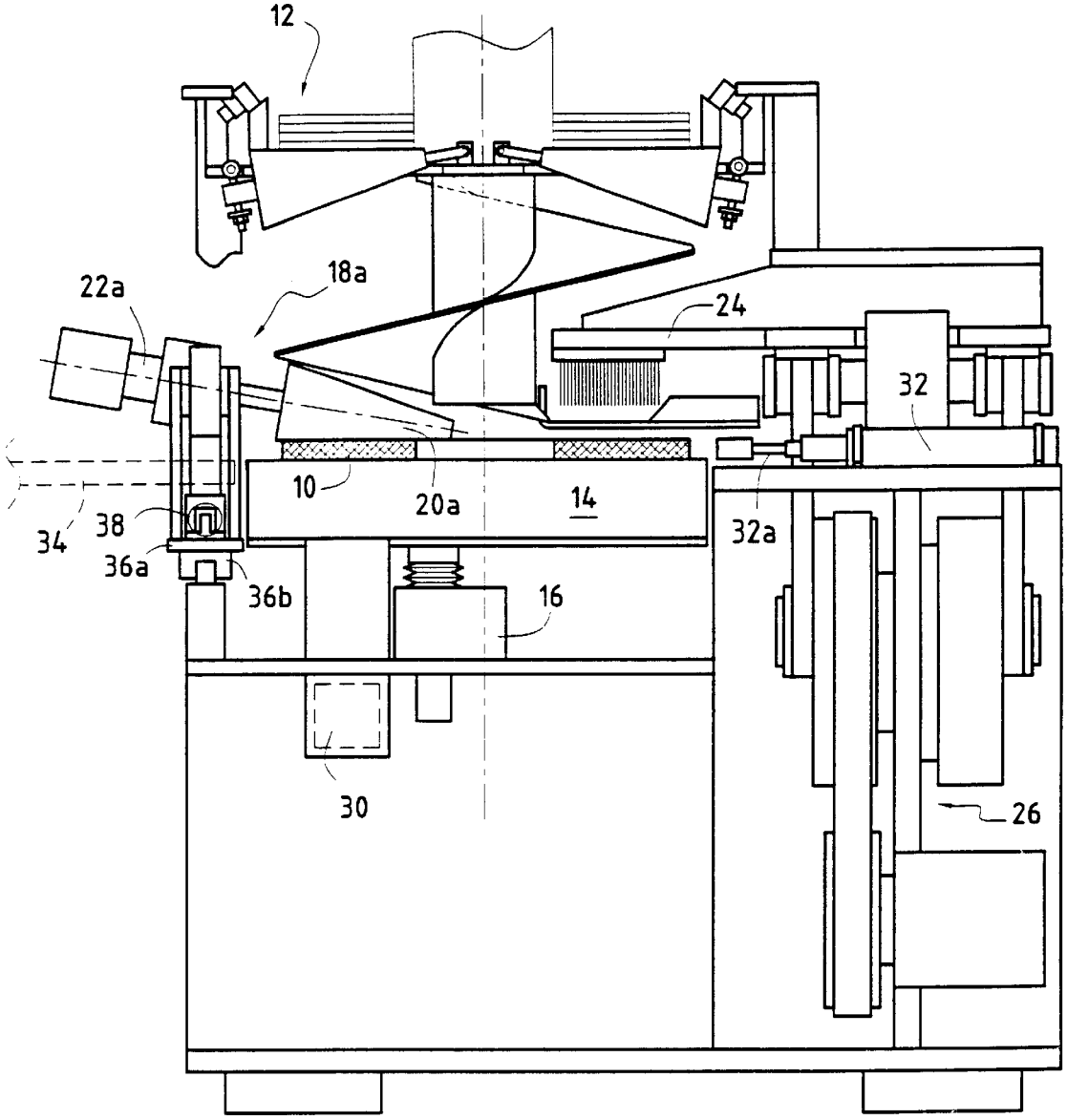
FIG. 1 is an elevation view of a needling machine including an automatic preform removal device of the invention.

FIG. 1 is a diagram showing a circular type needling machine having a smooth table (but it would naturally also be possible to apply the invention to a machine having a brush table) for use in needling a textile structure or annular preform, the machine being provided with a device of the invention for automatically removing the structure after it has been needled.

Conventionally, such a textile structure 10 for needling in a needling machine is made up of a plurality of superposed layers, which in circular needling are delivered continuously from helical strip supply means 12 of the kind described in greater detail in the patent application entitled "Feeding a needling machine with a continuous spiral strip" filed on the same day as the present applicant and assigned to the present Assignee, and to which reference is hereby made.

The helical strip of woven or non-woven fabric which is unwound progressively as it advances comes into position on a needling table 14 forming a winding platen for said strip that is vertically movable by vertical transmission means 16, and it is then driven on said table by drive means 18*a*, 18*b*, 18*c* advantageously constituted by three conical rollers 20*a*, 20*b*, 20*c* each actuated by an independent motor and gear box unit 22*a*, 22*b*, 22*c*, and preferably disposed with their axes angularly spaced by 120°. The textile strip is needled by a needling head 24 having a determined number of barbed needles and placed over the needling table between two conical drive rollers (e.g. the rollers 20*b* and 20*c*). In order to needle the various layers to one anther, this needling head is driven with vertical reciprocating motion by conventional drive means 26. Cutting means 28 are placed upstream from the needling zone to cut the textile strip once a predetermined final thickness has been obtained for the preform (sensors that are not shown serve to monitor this thickness accurately).

Central control means 30 connected to the vertical transmission means 16 for the needling table, to the textile structure drive means 18, to the reciprocating drive means 26 for the head, and to the cutting means 28 serve to provide the necessary control and synchronization for obtaining a continuous needling process.

In the invention, one (20*a*) of the three conical rollers and the associated motor and gear box unit 22*a* forming part of the drive means are at least partially movable and can be retracted to leave an empty space over the needling table for facilitating the action of ejector means for removing the textile structure from the needling table. This empty space is preferably established outside (e.g. opposite from) the needling zone.

Figure 2A:
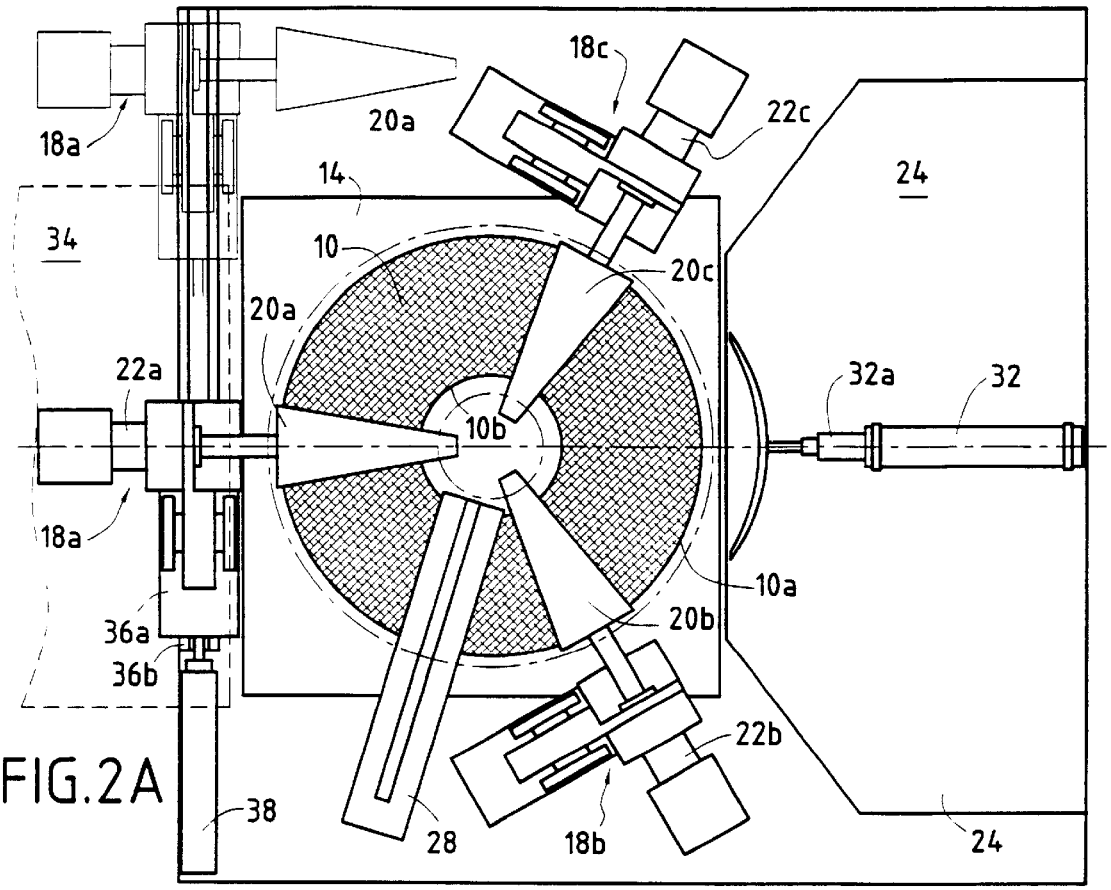
FIGS. 2A and 2B are plan views showing two distinct embodiments of the FIG. 1 device.

In a first embodiment (see FIG. 2A), the ejector means are placed in said needling zone beneath the needling head, substantially level with the needling table and they can be implemented as a simple actuator 32 whose advantageously telescopic thrust rod 32*a* acts directly on the periphery 10*a* of the annular preform so that said preform is pushed off the needling table, e.g. directly onto a conveyor 34 for removing finished products and disposed outside the machine level with the needling table. The conical roller drive means 18*a* is advantageously mounted on a support plate 36*a* which can slide on a rail 36*b* extending perpendicularly to the thrust direction of the actuator. It is moved along said rail under the control of the central control means 30 acting via appropriate drive means 38, e.g. an electrically controlled actuator.

Figure 2B:
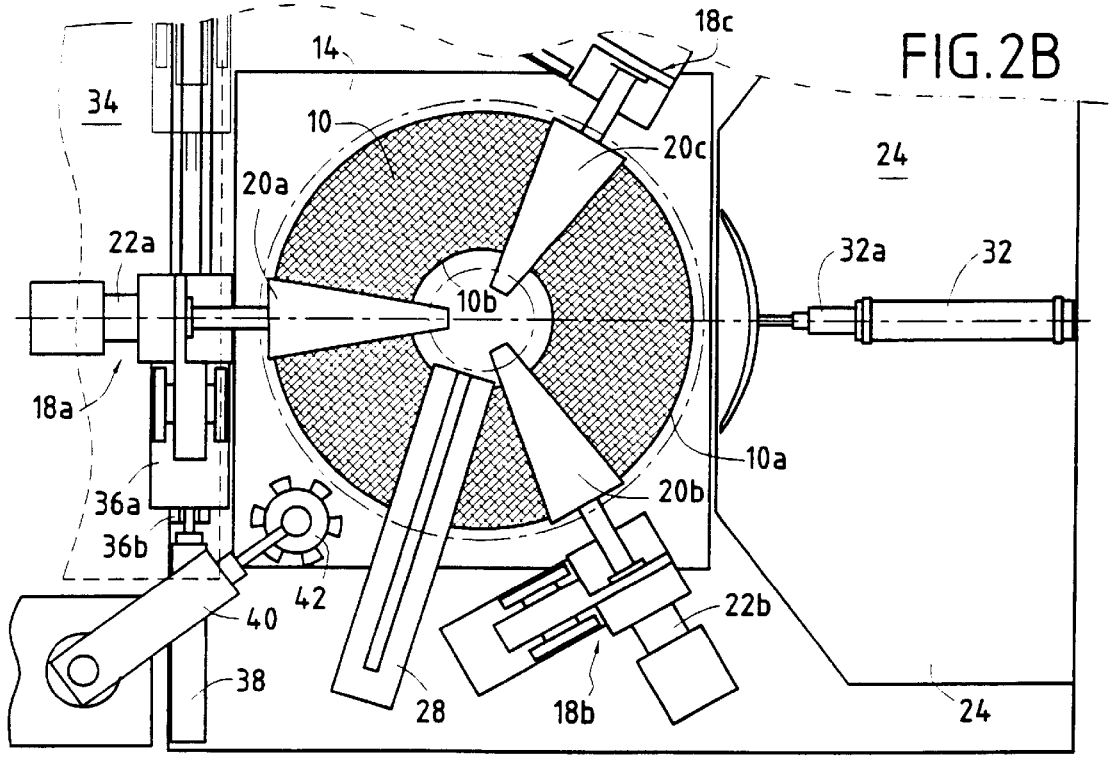

In a variant embodiment shown in FIG. 2B, the ejector means can be constituted by a manipulator arm 40 provided with extensible terminal grip means 42 for directly taking hold of the annular preform, e.g. through its central opening 10*b*, and then moving it to the conveyor 34 for evacuation purposes. The arm is advantageously located off the needling table, but in a region that is nevertheless close to the needling zone so as to avoid using a manipulator arm that is too bulky. Like the preceding thrust actuator, this manipulator arm is under the direct control of the central control means 30 for the needling machine and operates synchronously with the general needling process so as to remove needled preforms automatically.

It will be observed that the manipulator arm can also be used not only instead of but also together with the thrust actuator, particularly when for reasons of available space, for example, the conveyor cannot be placed immediately adjacent to the needling table but is spaced apart from or relatively remote therefrom.

Figure 3:
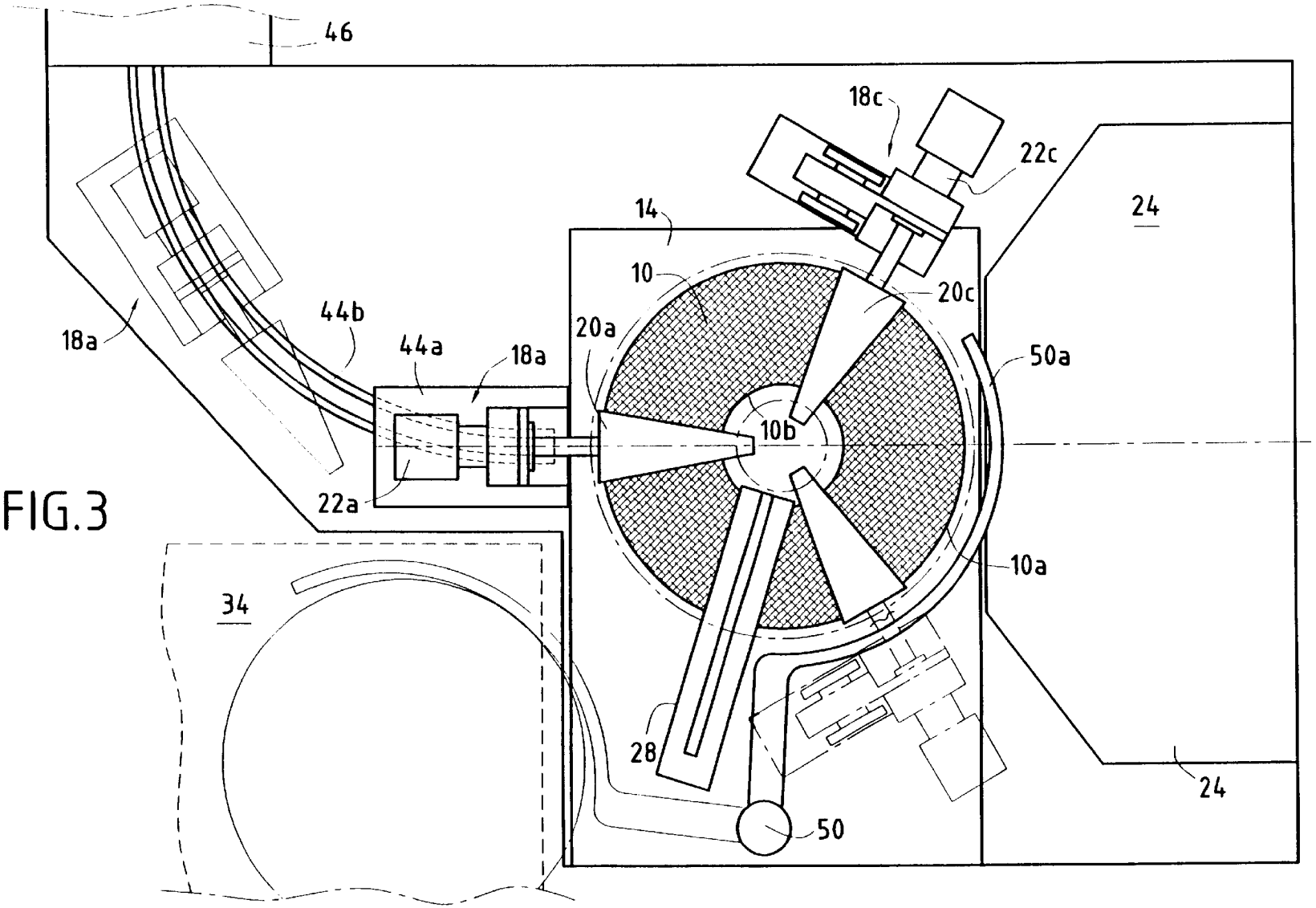
FIG. 3 is a plan view showing another embodiment of the device of the invention.

In another embodiment of the invention, shown in FIG. 3, the conical roller drive means 18*a* is mounted on a support plate 44*a* slidable on a rail 44*b* extending in a circular arc in a horizontal plane to a retracted position in which the moving drive means (shown in fine lines) is substantially perpendicular to its initial drive position. Movement on this rail is controlled by the central control means 30 using suitable drive means 46, e.g. a simple electric motor. It will be observed that the moving means can be taken out of the way equally well in a vertical plane.

In this alternative embodiment, the thrust means are preferably placed around the needling zone, substantially around the needling table, and can be implemented by a pivoting fork-shaped part 50 which is pivoted directly under the control of the central control means 30 of the needling machine synchronously with the general needling process and which has a thrust tine 50*a* acting directly on the periphery 10*a* of the annular preform so that said preform is pushed off the needling table, e.g. directly onto a conveyor 34 for removing finished products and placed outside the machine, level with the needling table.

What is claimed is:

1. A needling machine for needling a textile structure built up from a helical strip delivered by strip supply means, the machine comprising a needling table that is vertically movable, a needling head including a determined number of barbed needles and placed over said needling table in a needling zone, and driven with vertical reciprocating motion, cutting means for cutting said strip once a predetermined thickness for said textile structure has been obtained, and conical roller drive means for rotating said strip on said needling table until a textile structure has been built up with said predetermined thickness, wherein at least a fraction of said conical roller drive means is movable so as to be retracted to release an empty space over said needling table enabling ejector means to remove said textile structure from said needling table.

2. A needling machine according to claim 1, wherein said ejector means comprise thrust means placed level with said needling table.

3. A needling machine according to claim 1, wherein said thrust means comprise an actuator whose thrust rod acts directly on the periphery of said textile structure.

4. A needling machine according to claim 1, wherein said thrust means comprise a pivoting fork whose thrust tine acts directly on the periphery of said textile structure.

5. A needling machine according to claim 2, wherein at least one of said conical roller drive means is mounted on a support plate suitable for sliding on a rail extending transversely to the thrust direction of said thrust means and includes drive means for enabling said support plate to be moved along said rail.

6. A needling machine according to claim 5, wherein said drive means comprise an electrically controlled actuator.

7. A needling machine according to claim 2, wherein at least one of said conical roller drive means is mounted on a support plate capable of sliding on a rail extending in a circular arc away from an initial, driving position and including drive means for enabling said support plate to be moved along said rail.

8. A needling machine according to claim 1, wherein said ejector means comprise a manipulator arm provided with grip means for taking hold of said textile structure and for removing it from said needling table.

* * * * *